US008100228B2

(12) United States Patent
Hamilton et al.

(10) Patent No.: US 8,100,228 B2
(45) Date of Patent: Jan. 24, 2012

(54) PORTABLE ANCHORAGE ASSEMBLY

(75) Inventors: Garry Ernest John Hamilton, Rosenort (CA); J. Thomas Wolner, Red Wing, MN (US)

(73) Assignee: D B Industries, Inc., Red Wing, MN (US)

( * ) Notice: Subject to any disclaimer, the term of this patent is extended or adjusted under 35 U.S.C. 154(b) by 584 days.

(21) Appl. No.: 12/248,360

(22) Filed: Oct. 9, 2008

(65) Prior Publication Data

US 2009/0114478 A1 May 7, 2009

Related U.S. Application Data

(60) Provisional application No. 60/979,571, filed on Oct. 12, 2007.

(51) Int. Cl.
*E04G 1/24* (2006.01)

(52) U.S. Cl. ..... 182/142; 182/3; 182/45; 212/198; 280/43

(58) Field of Classification Search ..... 182/3, 142, 182/45; 212/179, 198; 280/43, 43.17, 43.22, 280/43.24
See application file for complete search history.

(56) References Cited

U.S. PATENT DOCUMENTS

| | | | | |
|---|---|---|---|---|
| 4,817,758 | A | 4/1989 | Gilmore | |
| 4,925,358 | A * | 5/1990 | Cook | 414/685 |
| 5,065,838 | A | 11/1991 | Finley | |
| 5,112,183 | A * | 5/1992 | Nusbaum et al. | 414/544 |
| 5,135,078 | A | 8/1992 | Bell et al. | |
| 6,227,553 | B1 | 5/2001 | Palmer | |
| 6,279,764 | B1 * | 8/2001 | Stoof | 212/177 |
| 7,032,710 | B2 | 4/2006 | Anderson et al. | |
| 7,080,469 | B2 * | 7/2006 | Ganswich | 37/405 |
| 2007/0289811 | A1 | 12/2007 | Smith | |

OTHER PUBLICATIONS

"Miller® Edge™ Fall Protection System", www.bacou-dalloz.com, 4 pages (Known of prior to filing of current patent application).
"Capital Safety Counterweight Systems", www.uclsafetysystems.com, 4 pages ( © 2006).
UCL Safety Systems, ISO 9001 Registered & C E Certified, "Man Rated Confined Space Entry/Retrieval Systems UCL Counterweight System Operator's Manual", 25 pages (Oct. 5, 2000).
"Mobile Fall Protection System—Model PR-600", Protective Roofing Products Ltd., www.prplimited.com/products.asp?product=6, 1 page (Printed Sep. 24, 2007).
"PR 600 Mobile Fall Protection System for Flat Roofs", Protective Roofing Products Ltd., 4 pages (Known of prior to filing of current patent application).
"PR 600 Mobile Fall Protection System—Assembly Instructions", Protective Roofing Products Ltd., 6 pages (Known of prior to filing of current patent application).

* cited by examiner

*Primary Examiner* — Katherine W Mitchell
*Assistant Examiner* — Daniel Cahn
(74) *Attorney, Agent, or Firm* — IPLM Group, P.A.

(57) ABSTRACT

A portable anchorage assembly comprises an extension member interconnecting a counterweight assembly and a base. The counterweight assembly has a cavity configured and arranged to receive at least one weight. The extension member has a first end and a second end. The first end is pivotally connected to the counterweight assembly. The base is connected to the second end of the extension member and includes a wheel and at least one anchorage point. The base is pivotable about the counterweight assembly on the wheel to position the at least one anchorage point in a desired location.

1 Claim, 16 Drawing Sheets

FIG. 2
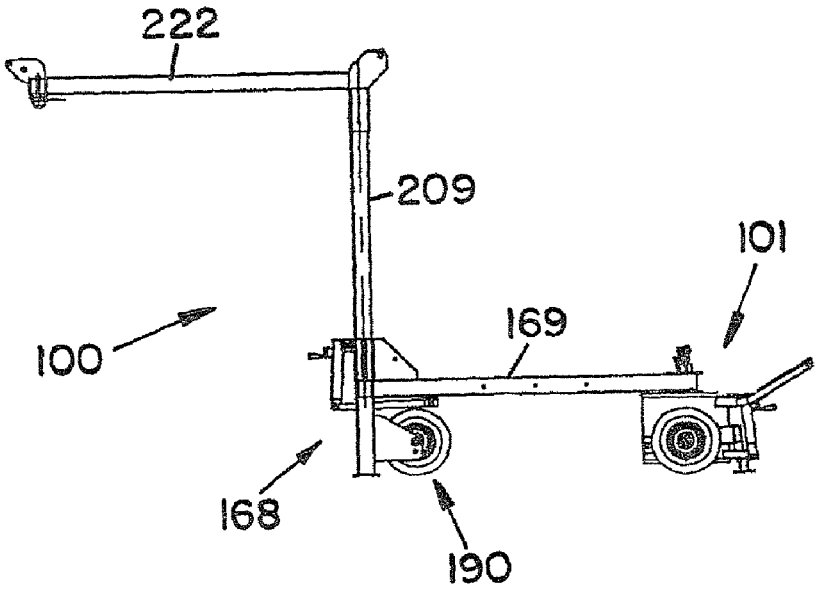
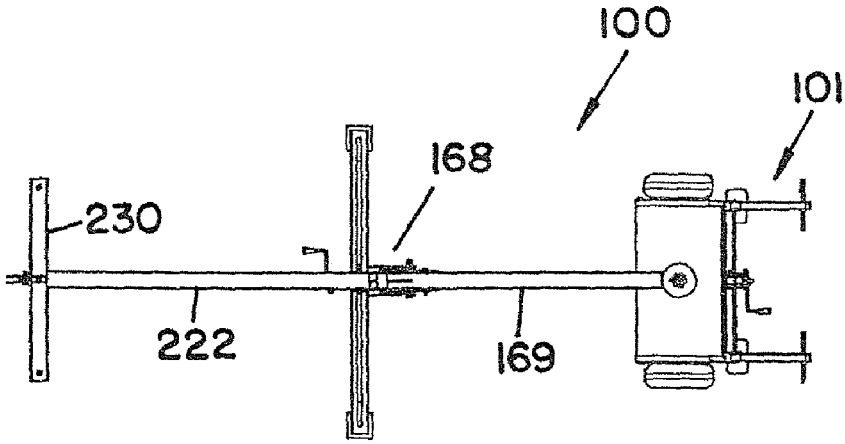
FIG. 3

FIG. 12
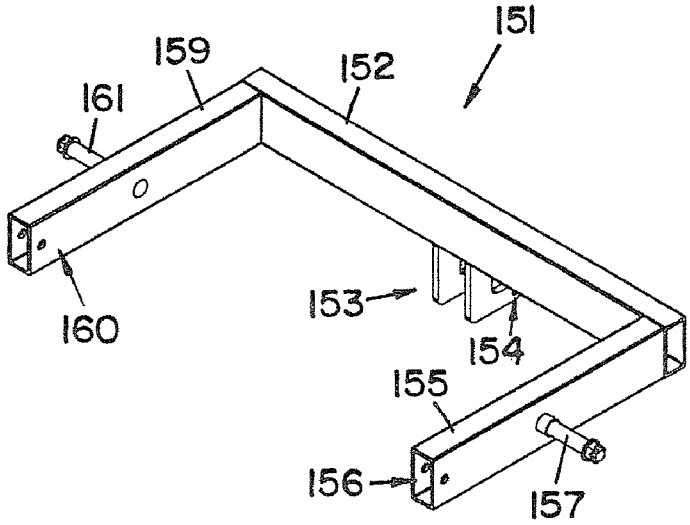
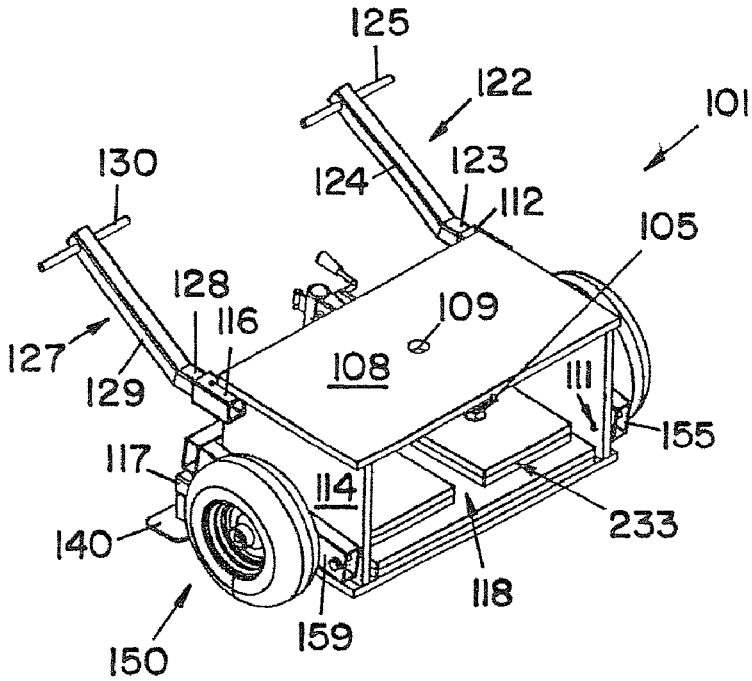
FIG. 13

FIG. 15
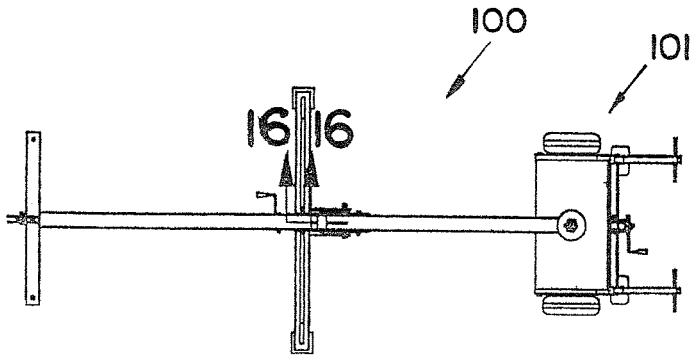
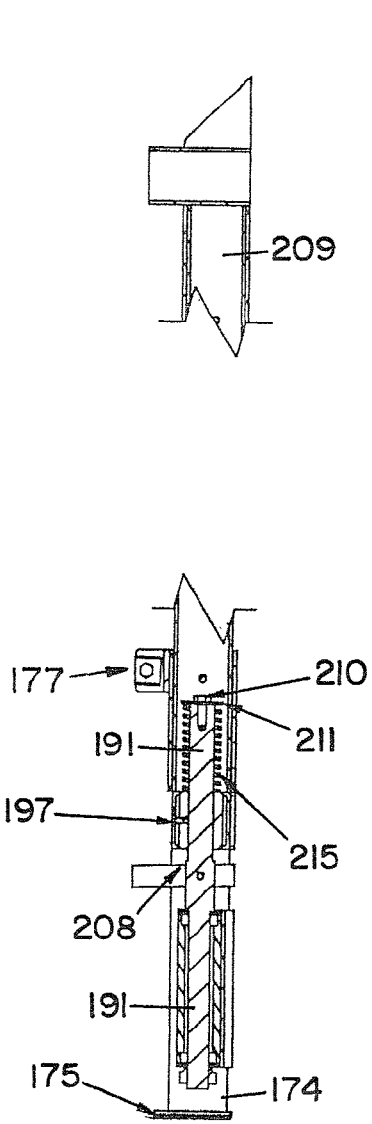
FIG. 16

FIG.17
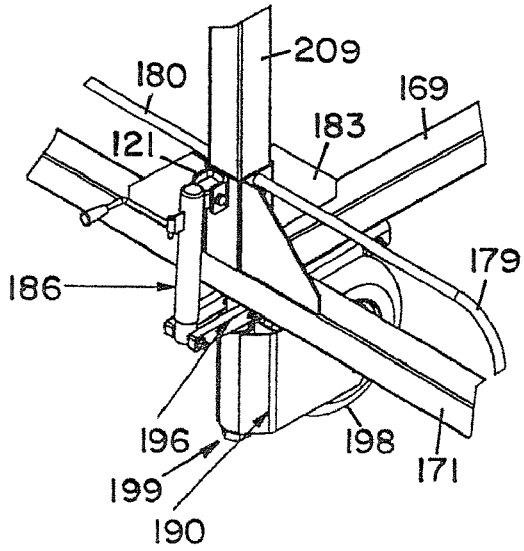
FIG.18
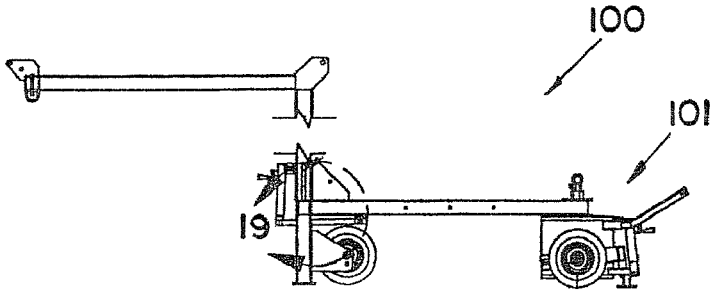
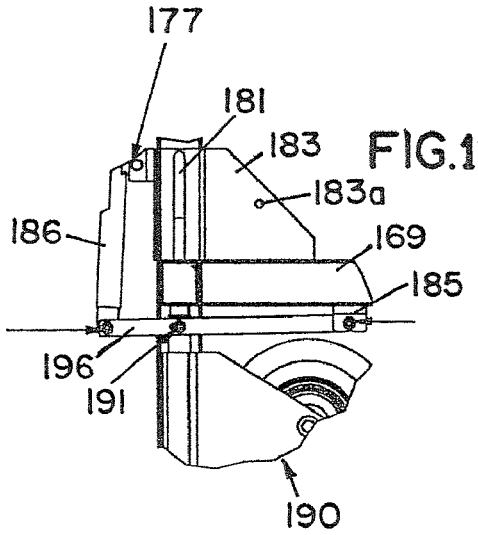
FIG.19

FIG. 22
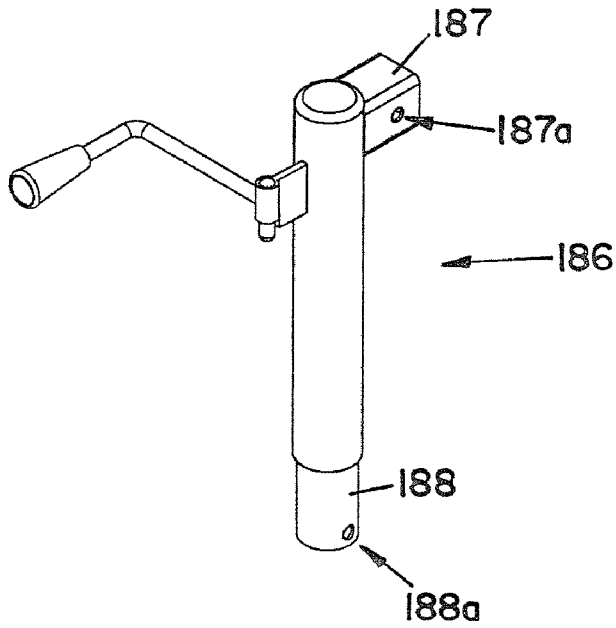
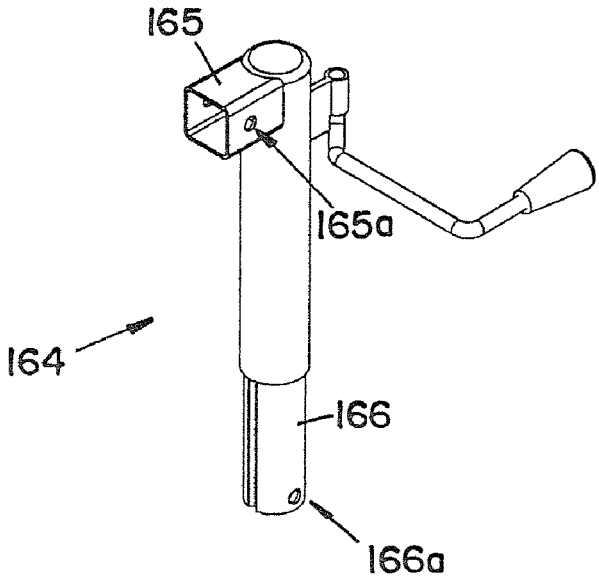
FIG. 21

FIG. 25
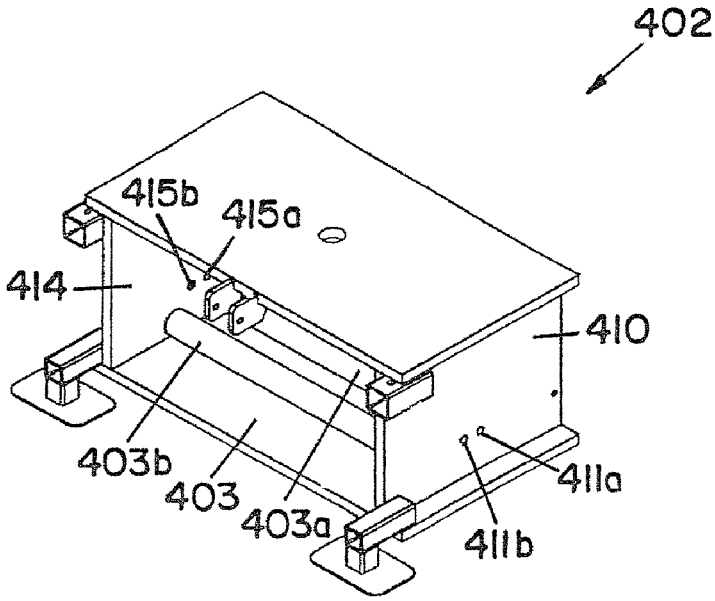
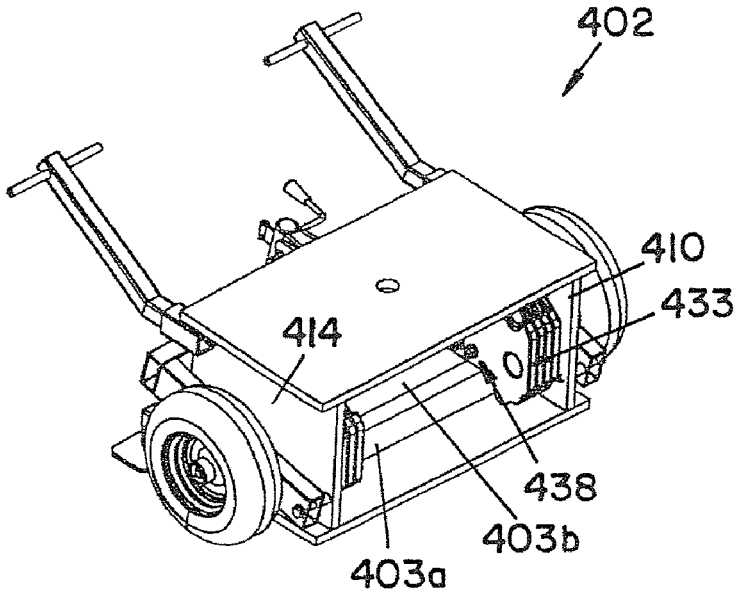
FIG. 26

PORTABLE ANCHORAGE ASSEMBLY

This application claims the benefit of U.S. Provisional Application Ser. No. 60/979,571, filed Oct. 12, 2007.

FIELD OF THE INVENTION

The present invention relates to a portable anchorage assembly.

BACKGROUND OF THE INVENTION

Various occupations place people in precarious positions at relatively dangerous heights thereby creating a need for fall arrest and fall protection safety apparatus. Among other things, such apparatus usually include a safety line interconnected between a support structure and a person working in proximity to the support structure. The safety line is typically secured to a full-body safety harness worn by the worker.

Portable anchorage assemblies could be used, but obviously, the support structure must be designed to remain secure in the event of a fall. Possible applications in which portable anchorage assemblies could be used include concrete deck construction, bridge deck construction, window washing, and other suitable applications.

The present invention addresses the problems associated with the prior art devices and provides for a more user-friendly portable anchorage assembly.

SUMMARY OF THE INVENTION

One aspect of the present invention provides a portable anchorage assembly comprising an extension member interconnecting a counterweight assembly and a base. The counterweight assembly has a cavity configured and arranged to receive at least one weight. The extension member has a first end and a second end. The first end is pivotally connected to the counterweight assembly. The base is connected to the second end of the extension member and includes a wheel and at least one anchorage point. The base is pivotable about the counterweight assembly on the wheel to position the at least one anchorage point in a desired location.

Another aspect of the present invention provides a counterweight assembly of a portable anchorage assembly comprising a housing, a rear wheel assembly, and a rear jack assembly. The housing has a cavity configured and arranged to receive at least one weight. The rear wheel assembly includes a bracket and at least one rear wheel. The bracket has a front portion and a rear portion. The front portion pivotally interconnects the at least one rear wheel and the housing. The rear jack assembly interconnects the rear portion of the bracket and the housing. The rear jack assembly is adjustable in length to move the housing and the rear wheel assembly relative to one another. As the rear jack assembly increases in length, the rear wheel assembly is moved downward and the housing is moved upward thus moving the at least one rear wheel downward to contact a support surface thereby moving the rear wheel assembly from an anchorage position into a mobile position. The mobile position of the rear wheel assembly positions a center of gravity of the counterweight assembly proximate the at least one rear wheel to assist in moving the counterweight assembly. As the rear jack assembly decreases in length, the rear wheel assembly is moved upward and the housing is moved downward thus moving the at least one rear wheel out of contact with the support surface and contacting the support surface with a rear portion of the housing. As the rear wheel assembly is moved from the mobile position to the anchorage position, the center of gravity of the counterweight assembly is moved from proximate the at least one rear wheel to more proximate a front of the counterweight assembly.

Another aspect of the present invention provides a portable anchorage assembly comprising a counterweight assembly, a base, and an extension member. The counterweight assembly includes a housing having a cavity configured and arranged to receive at least one weight, a rear wheel assembly having at least one rear wheel and pivotally connected to the housing, and a rear jack assembly interconnecting the housing and the rear wheel assembly. The base includes a cross bar and at least one anchorage point. The cross bar interconnects a first leg and a second leg. The extension member has a first end and a second end. The first end is pivotally connected to the housing and the second end is connected to the cross bar between the first leg and the second leg. A front wheel assembly has at least one front wheel and is pivotally connected to the base. The base is pivotable about the counterweight assembly on the at least one front wheel to position the at least one anchorage point in a desired location. A front jack assembly interconnects the front wheel assembly and the base. The rear jack assembly and the front jack assembly are adjustable in length to raise and lower the respective wheel assemblies, each of the wheel assemblies having an anchorage position and a mobile position. As the rear jack assembly increases in length, the rear wheel assembly is moved downward and the housing is moved upward thus moving the at least one rear wheel downward to contact a support surface thereby moving the rear wheel assembly from the anchorage position into the mobile position. The mobile position of the rear wheel assembly positions a center of gravity of the counterweight assembly proximate the rear wheel assembly to assist in moving the counterweight assembly. As the front jack increases in length, the front wheel assembly is moved downward and the base is moved upward thus moving the at least one front wheel downward to contact the support surface thereby moving the front wheel assembly from the anchorage position into the mobile position. As the rear jack assembly decreases in length, the rear wheel assembly is moved upward and the housing is moved downward thus moving the at least one rear wheel out of contact with the support surface and contacting the support surface with a rear portion of the housing. As the rear wheel assembly is moved from the mobile position to the anchorage position, the center of gravity of the counterweight assembly is moved from proximate the rear wheel assembly to more proximate a front of the counterweight assembly thereby transferring weight to the base thereby increasing the downward force on the base and making the portable anchorage assembly more stable as an anchorage structure.

Another aspect of the present invention provides a method of securing a safety harness to a lifeline of a portable anchorage assembly. The portable anchorage assembly is moved to a desired location. The portable anchorage assembly comprises a counterweight assembly, an extension member, and a base. The counterweight assembly has a cavity configured and arranged to receive at least one weight and a rear wheel assembly. The extension member has a first end and a second end. The first end is pivotally connected to the counterweight assembly. The base is connected to the second end of the extension member and includes a front wheel assembly and at least one anchorage point. The base is pivotable about the counterweight assembly on the front wheel assembly. The rear wheel assembly and the front wheel assembly each have a mobile position and an anchorage position. The rear wheel assembly is moved from the mobile position to the anchorage position. The at least one weight is placed in the cavity of the counterweight assembly. The base is pivoted to position the at least one anchorage point in a desired position. The front wheel assembly is moved from the mobile position to the anchorage position. The lifeline is connected to the at least one anchorage point, and the lifeline is connected to the safety harness.

BRIEF DESCRIPTION OF THE DRAWINGS

FIG. 2 is a side view of the portable anchorage assembly shown in FIG. 1;

FIG. 3 is a top view of the portable anchorage assembly shown in FIG. 1;

FIG. 12 is a perspective view of the wheel mount bracket shown in FIG. 11;

FIG. 13 is a front perspective view of the counterweight assembly shown in FIG. 5;

FIG. 15 is a top view of the portable anchorage assembly shown in FIG. 1;

FIG. 16 is a cross section view taken along the lines 16-16 in FIG. 15;

FIG. 17 is a perspective view of a front wheel assembly of the portable anchorage assembly shown in FIG. 1;

FIG. 18 is a side view of the portable anchorage assembly shown in FIG. 1;

FIG. 19 is a side view of portion E shown in FIG. 18;

FIG. 21 is a perspective view of a rear jack of the portable anchorage assembly shown in FIG. 1;

FIG. 22 is a perspective view of a front jack of the portable anchorage assembly shown in FIG. 1;

FIG. 25 is a rear perspective view of another embodiment counterweight housing;

FIG. 26 is a front perspective view of the counterweight housing shown in FIG. 25 with a wheel assembly and weights connected thereto;

DETAILED DESCRIPTION OF A PREFERRED EMBODIMENT

Figure 1:
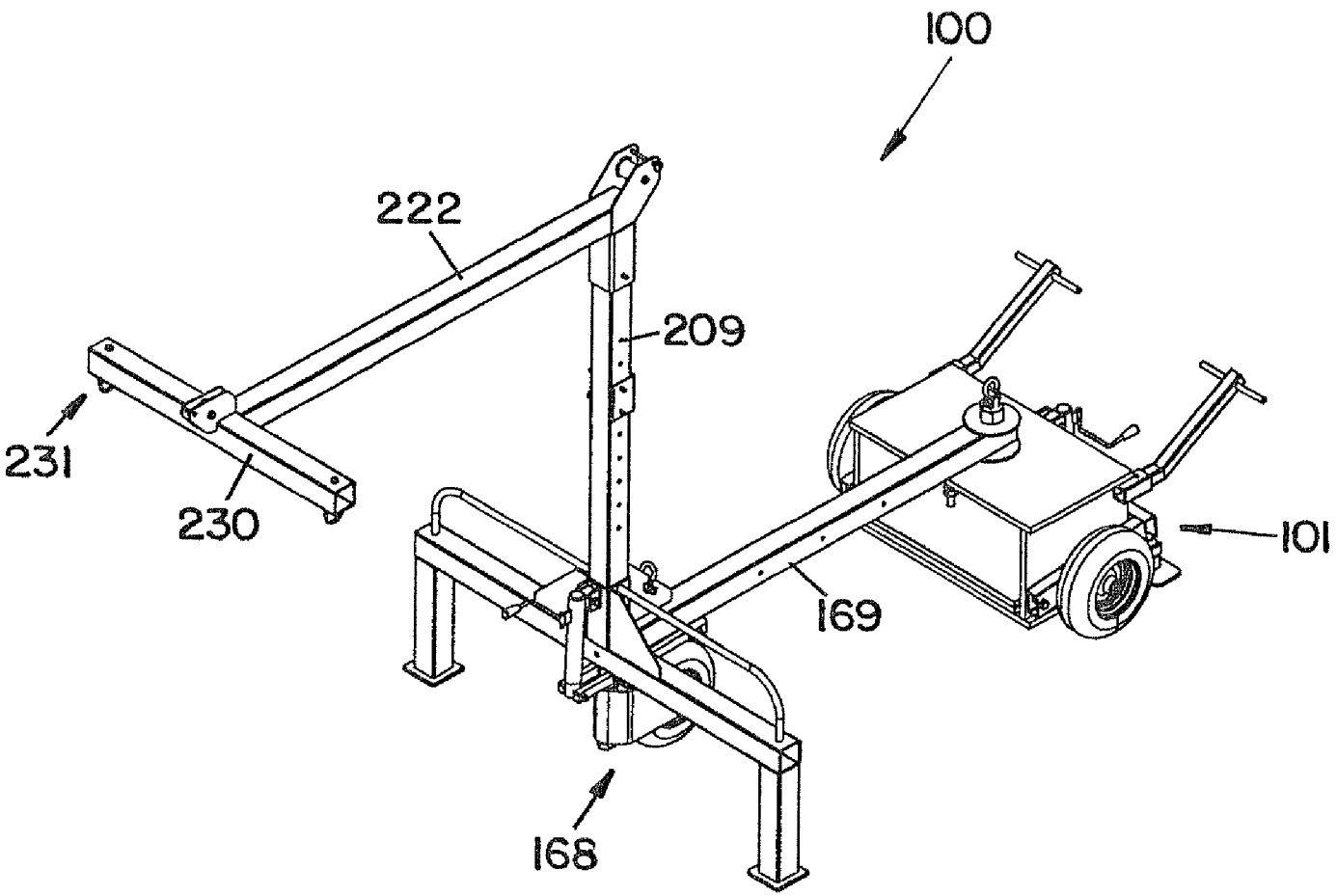
FIG. 1 is a perspective view of a portable anchorage assembly constructed according to the principles of the present invention.

A preferred embodiment portable anchorage assembly constructed according to the principles of the present invention is designated by the numeral 100 and by the numeral 300 in the drawings.

Figure 4:
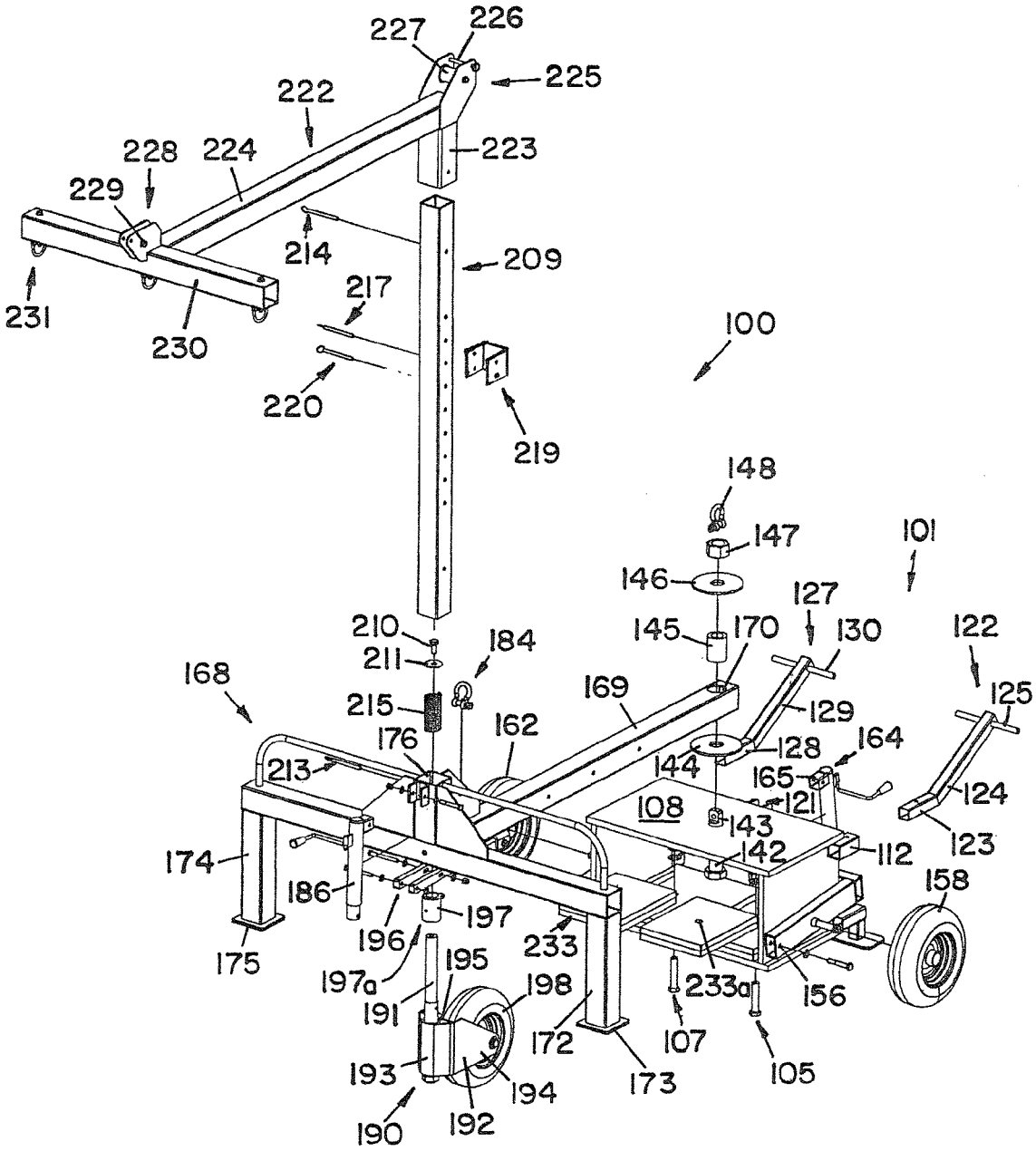
FIG. 4 is an exploded perspective view of the portable anchorage assembly shown in FIG. 1.

The portable anchorage assembly 100 generally includes a counterweight assembly 101, a base 168, and an anchor member 230. The counterweight assembly 101 includes a counterweight housing 102 shown in FIGS. 6-10. The counterweight housing 102 has a bottom 103 and a top 108 interconnected by a first side 110 and a second side 114 defining a cavity 118 accessible through a front opening 119 and a rear opening 120. The bottom 103 preferably includes a first plate 103*a* and a second plate 103*b* for added weight. The bottom 103 also includes a first aperture 104 through which extends a first threaded rod 105 and a second aperture 106 through which extends a second threaded rod 107 as shown in FIG. 4. The top 108 includes an aperture 109 through which a bolt 142 having an aperture 143 at its distal end extends and a forked protrusion 121 with apertures 121*a* extending outward from its rear side. The first side 110 includes an aperture 111 proximate the bottom 103 and the front, a first handle connector 112 proximate the top 108 and the rear, and a first foot connector 113 proximate the bottom 103 and the rear. The second side 114 includes an aperture 115 proximate the bottom 103 and the front, a second handle connector 116 proximate the top 108 and the rear, and a second foot connector 117 proximate the bottom 103 and the rear.

A first handle assembly 122 includes a connector portion 123, which is releasably connectable to the first handle connector 112, an extension portion 124 extending outward at an angle from the connector portion 123, and a handle 125 extending outward laterally from the extension portion 124. A second handle assembly 127 includes a connector portion 128, which is releasably connectable to the second handle connector 116, an extension portion 129 extending outward at an angle from the connector portion 128, and a handle 130 extending outward laterally from the extension portion 129.

A first foot assembly 132 includes a foot 134 extending downward from the first foot connector 113, and a rubber footing 135 provides a non-slip surface on the bottom of the foot 134. A second foot assembly 137 includes a foot 139 extending downward from the second foot connector 117, and a rubber footing 140 provides a non-slip surface on the bottom of the foot 139.

Figure 5:
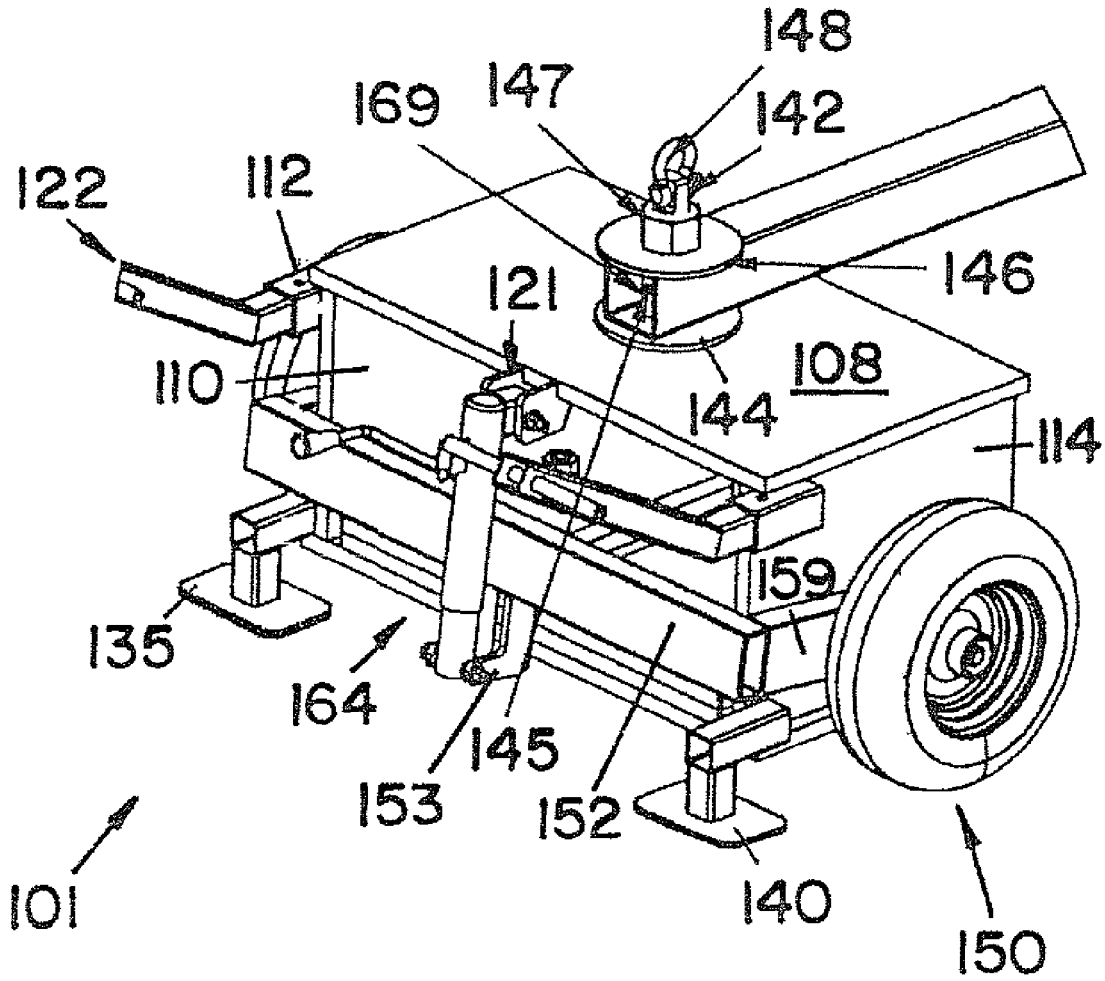
FIG. 5 is a rear perspective view of a counterweight assembly of the portable anchorage assembly shown in FIG. 1.
Figure 6:
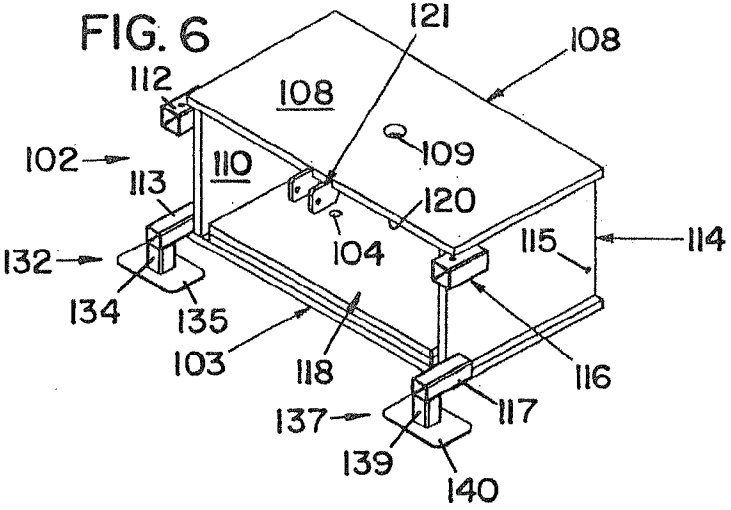
FIG. 6 is a rear perspective view of a counterweight housing of the counterweight assembly shown in FIG. 5.
Figure 10:
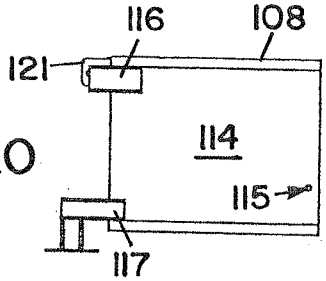
FIG. 10 is a side view of the counterweight housing shown in FIG. 6.
Figure 7:
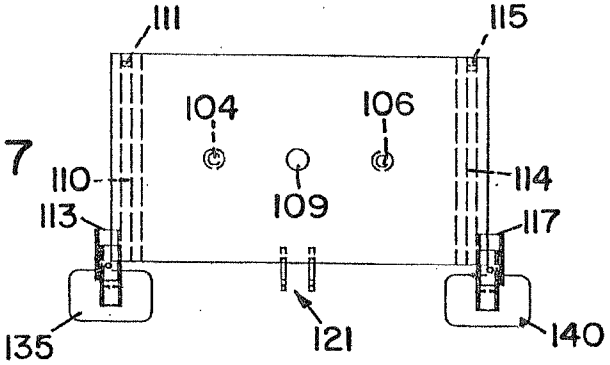
FIG. 7 is a top view of the counterweight housing shown in FIG. 6.
Figure 8:
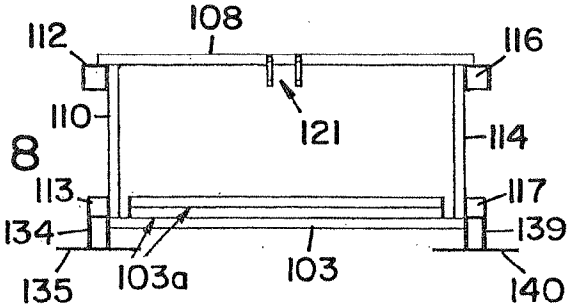
FIG. 8 is a rear view of the counterweight housing shown in FIG. 6.
Figure 9:
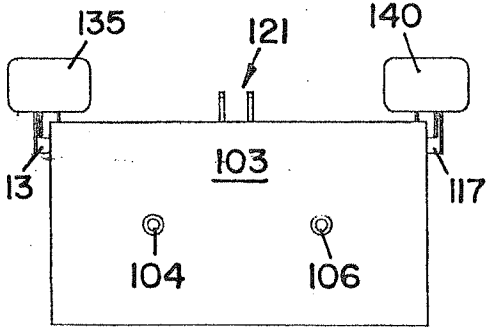
FIG. 9 is a bottom view of the counterweight housing shown in FIG. 6.
Figure 11:
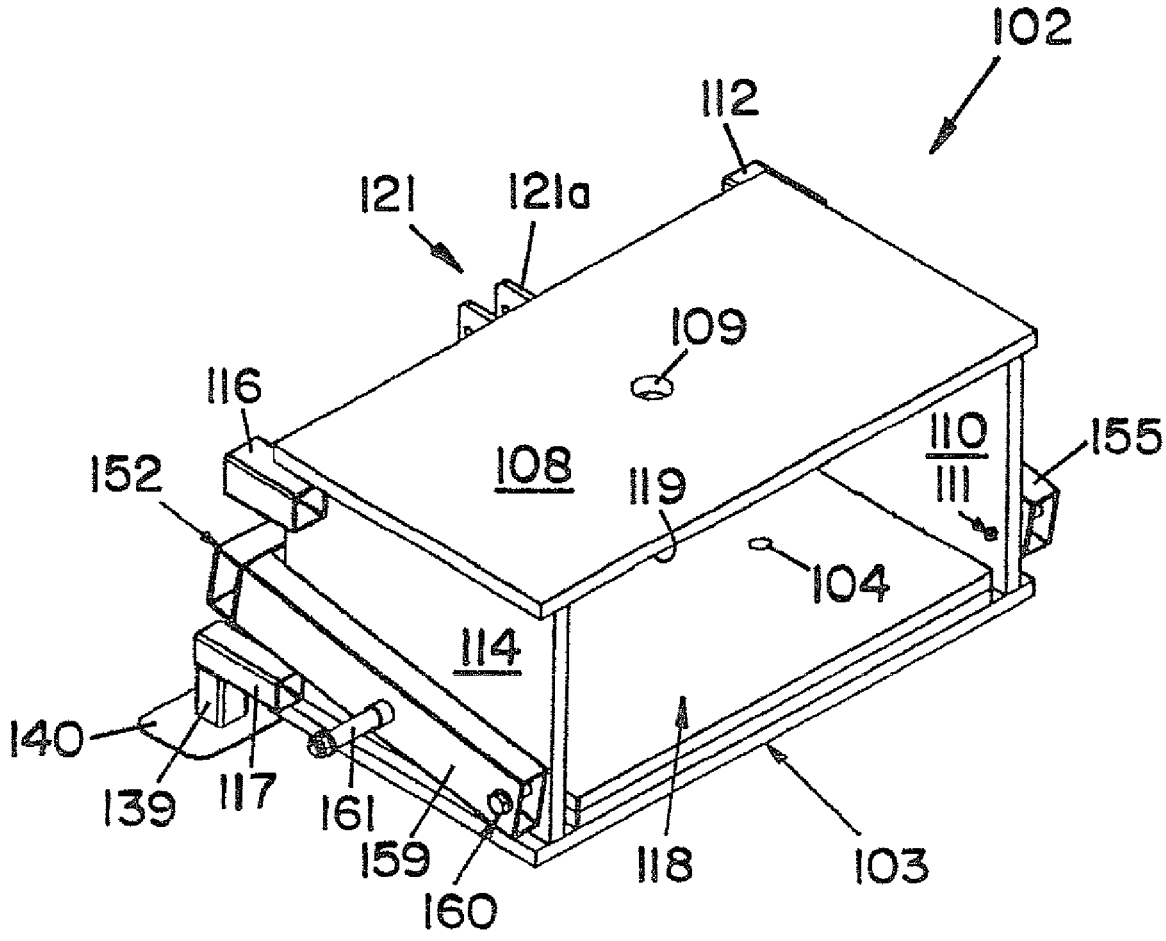
FIG. 11 is a front perspective view of the counterweight housing shown in FIG. 6 with a wheel mount bracket connected thereto.

A wheel mount assembly 150 is shown connected to the counterweight housing 102 in FIG. 5. The wheel mount assembly 150 includes a bracket 151, shown in FIG. 12, including a cross bar 152 from which a first side 155 and a second side 159 extend forward from the ends of the cross bar 152. The cross bar 152 includes a forked protrusion 153 with apertures 154 extending outward rearwardly proximate the middle of the cross bar 152. The first side 155 includes apertures 156 proximate its distal end and a first connector 157 extending outward proximate the middle of the first side 155. A first wheel 158 is connected to the first connector 157. The second side 159 includes apertures 160 proximate its distal end and a second connector 161 extending outward proximate the middle of the second side 159. A second wheel 162 is connected to the second connector 161. The apertures 156 align with the aperture 111 in the first side 110 and a fastener is inserted therethrough to connect the first side 155 to the first side 110. The apertures 160 align with the aperture 115 in the second side 114 and a fastener is inserted therethrough to connect the second side 159 to the second side 114.

The cavity 118 of the counterweight housing 102 is configured and arranged to receive an optional plurality of weight plates 233 including apertures 233*a*. If the plates 233 are used, the rods 105 and 107 are inserted through the apertures 233*a* and then a washer 234 is placed on each of the rods 105 and 107 and on the tops of the top plates 233, and lock nuts 235 are used to secure the plates 233 to the counterweight housing 102.

A rear jack 164, shown in FIG. 21, includes a top connector 165 with apertures 165*a* and a bottom connector 166 with apertures 166*a*. The top connector 165 fits between the two portions of the forked protrusion 121, and the apertures 165*a* align with the apertures 121*a* through which a fastener extends to connect the top of the rear jack 164 to the counterweight housing 102. The bottom connector 166 fits between the two portions of the forked protrusion 153, and the apertures 166*a* align with the apertures 154 through which a fastener extends to connect the bottom of the rear jack 164 to the bracket 151 of the wheel mount assembly 150.

An extension member 169 interconnects the counterweight assembly 101 and the base 168. The rear end of the extension member 169 includes an aperture 170 through which a mount bushing 145 extends, and the mount bushing 145 is preferably welded to the extension member 169. The bolt 142 extending through the aperture 109 in the top 108 of the counterweight housing 102 also extends through the mount bushing 145, which assists in pivoting the extension member 169 about the bolt 142. A first slider disk 144 is inserted onto the bolt 142 between the top 108 and the extension member 169, and a second slider disk 146 is inserted onto the bolt 142 on top of the extension member 169. A nut 147 is threaded onto the bolt 142 to secure these components onto the bolt 142. A screw pin shackle 148 may be connected to the end of the bolt 142 with a fastener inserted through the aperture 143.

Figure 14:
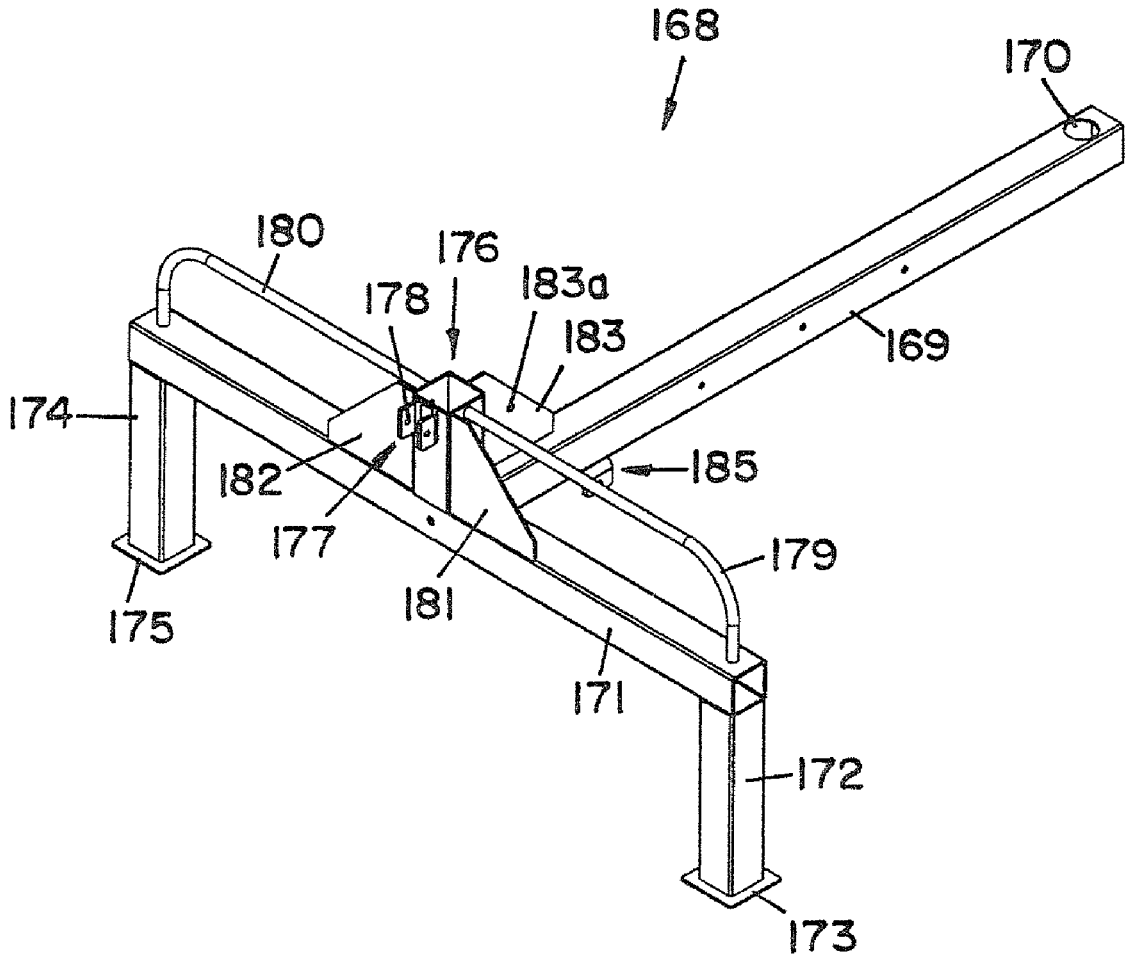
FIG. 14 is a perspective view of a base of the portable anchorage assembly shown in FIG. 1.

The other end of the extension member 169 is connected to the base 168. The extension member 169 and the base 168 are shown in FIG. 14. The base 168 includes a cross bar 171 with opposing ends to which a first leg 172 with a foot 173 and a second leg 174 with a foot 175 extend. The extension member 169 is preferably welded to a middle portion of the cross bar 171, and the legs 172 and 174 are preferably welded to the ends of the cross bar 171. A mast connector 176 is connected, preferably by welding, on the top of the cross bar 171 proximate the extension member 169. A forked protrusion 177 including apertures 178 extends outward forwardly from the mast connector 176. A first rail 179 is connected to the top of the mast connector 176 and the end of the cross bar 171 proximate the first leg 172. A second rail 180 is connected to the top of the mast connector 176 and the end of the cross bar 171 proximate the second leg 174. The extension member 169, the cross bar 171, the legs 172 and 174, and the mast connector 176 are preferably square-shaped tubular elongate members for light weight strength. A first support plate 181 is preferably a triangular plate interconnecting the side of the mast connector 176 and the top of the cross bar 171 proximate the first rail 179, and a second support plate 182 is preferably a triangular plate interconnecting the opposing side of the mast connector 176 and the top of the cross bar 171 proximate the second rail 180. A third support plate 183 is preferably a triangular plate with an aperture 183*a* interconnecting the rear of the mast connector 176 and the top of the extension member 169. A screw pin shackle 184 may be connected to the third support plate 183 with a fastener inserted through the aperture 183*a*. A U-shaped bracket 185 extends downward from the bottom of the extension member 169 proximate the third support plate 183.

Figure 20:
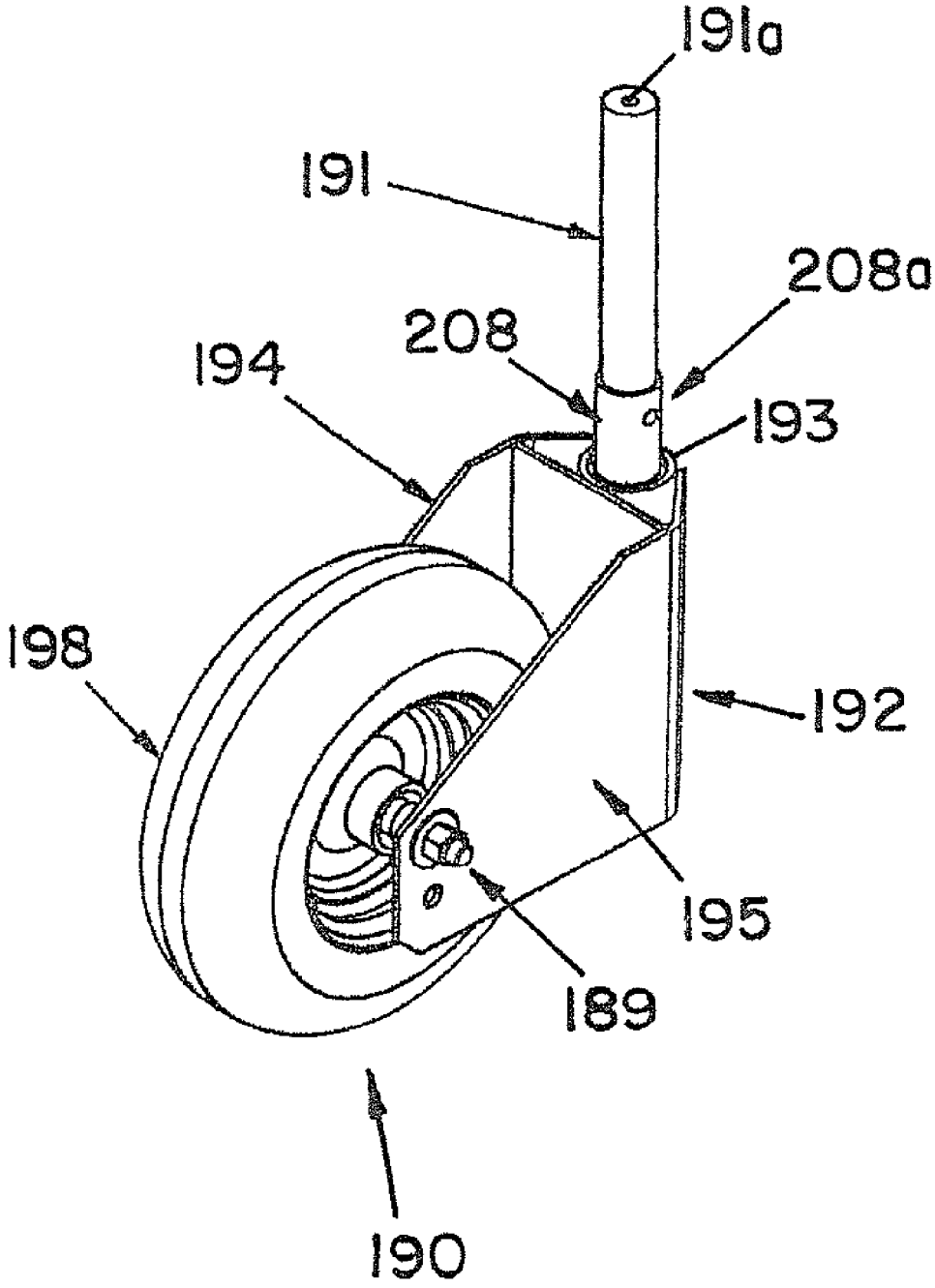
FIG. 20 is a perspective view of a front wheel of the front wheel assembly shown in FIG. 17.

A front wheel assembly 190, shown in FIG. 20, includes a shaft 191 to which a wheel 198 is connected with a bracket 192. The bracket 192 includes a base tube 193, to which the shaft 191 is connected, and a first arm 194 and a second arm 195, between which the wheel 198 is connected with a fastener 189. The fastener 189 preferably includes a spacer, a bolt, a washer, and a lock nut. The bottom of the shaft 191 is preferably connected to the bottom of the base tube 193 with a fastener 199. The fastener 199 preferably includes a bearing, more preferably two bearings, and a hex nut. A collar 208, which is preferably integral with the shaft 191 and is machined as a ledge on the shaft 191, is positioned proximate the base tube 193 and includes apertures 208*a*. Thus, the upper portion of the shaft 191 has a smaller diameter than the lower portion of the shaft 191. A mount bushing 197 with an aperture 197*a* is positioned over the shaft 191 proximate the collar 208. The cross bar 171 includes a bore (not shown) into which the mount bushing 197 is placed, and the mount bushing 197 is preferably welded to the cross bar 171 proximate the mast connector 176 so that the bore of the mount bushing 197 is in fluid communication with the bore of the mast connector 176. A compression spring 215 is positioned about the shaft 191 between the mount bushing 197 and a washer 211, which is connected to the top of the shaft 191 with a bolt 210 inserted into a longitudinal bore 191*a* in the shaft 191. Because the mount bushing 197 is welded to the cross bar 171, the spring 215 places an upward force on the washer 211 thus placing an upward force on the shaft 191. The upward force of the spring 215 assists in raising the front wheel assembly 190.

A front jack 186, shown in FIG. 22, includes a top connector 187 with apertures 187*a* and a bottom connector 188 with apertures 188*a*. As shown in FIGS. 17 and 19, the top connector 187 is connected to the forked protrusion 177 of the mast connector 176 and the bottom connector 188 is connected to a front jack mount bracket 196. The apertures 187*a* align with the apertures 178 and a fastener is inserted therethrough to connect the top of the front jack 186 to the mast connector 176. The apertures 188*a* align with a front aperture in the bracket 196 and a fastener is inserted therethrough to connect the bottom of the front jack 186 to the bracket 196. A middle portion of the bracket 196 is connected to the collar 208 with a fastener, and a rear portion of the bracket 196 is connected to the bracket 185 of the extension member 169 with a fastener. Washers are preferably used between the bracket 196 and the fasteners.

A vertical mast 209 fits within the mast connector 176 and extends vertically upward from the base 168. Different vertical masts having different lengths may be used. The optional weight plates 233 are preferably used when a longer vertical mast is used to extend the height of the anchor member 230. A fastener 213 releasably connects the vertical mast 209 to the mast connector 176. An optional mount bracket 219 is connected to the vertical mast 209 with a fastener 220 and provides a mounting surface for a winch or a self-retracting lifeline (not shown). A quick release pin 217 may be used to connect a winch or a self-retracting lifeline to the mount bracket 219. An extension mast 222 includes a horizontal extension 224 and a connector 223 connected to and extending downward from the horizontal extension 224. The connector 223 fits over the top of the vertical mast 209, and a fastener 214 releasably connects the connector 223 to the vertical mast 209. The horizontal extension 224 extends outward forwardly from the top of the vertical mast 209. An anchor member 230 is connected to the end of the horizontal extension 224, preferably perpendicular thereto, and includes at least one anchor point 231, preferably up to three anchor points spaced along the anchor member 230. FIGS. 1 and 4 show two anchor points, but the present invention is not limited to two anchor points.

A first bracket 225 is connected to the extension mast 222 proximate the juncture of the connector 223 and the horizontal extension 224 and includes a connector 226 and a roller 227. A second bracket 228 is connected to the extension mast 222 proximate the juncture of the horizontal extension 224 and the anchor member 230 and includes a connector (not shown) and a roller 229. If a winch or a self-retracting lifeline is connected to the mount bracket 219 on the vertical mast 209, the lifeline is positioned between the connectors and the rollers of the brackets 225 and 228, and the rollers 227 and 229 reduce the wear on the lifeline as it is paid out of and retracted into the lifeline housing. The connectors keep the lifeline positioned properly within the brackets 225 and 228.

The portable anchorage assembly 100 is preferably brought to the desired support surface with a crane (connected to the shackles 148 and 184) and then pushed into the desired location. The weight anchorage requirements should be calculated according to industry standards to determine whether weight plates 233 should be used. If weight plates 233 are used, it should also be determined how many weight plates 233 should be used. To push the portable anchorage assembly 100 into the desired location, the assembly is placed in a mobile position, which allows part or all of the assembly 100 to be moved to a different location. Once the assembly 100 is in the desired location, the assembly is placed in an anchorage position, which stabilizes the assembly 100 for use as an anchorage structure.

The portable anchorage assembly 100 is placed in the mobile position by lowering either just the front wheel 198 or both the front wheel 198 and the rear wheels 158 and 162. The front wheel 198 is lowered by rotating the handle of the front jack 186 to elongate the body of the front jack 186, which increases the distance between the mast connector 176 and the bracket 196 connected to the front wheel 198. Thus, the front wheel 198 is lowered by moving the cross bar 171 upward and moving the bracket 196 downward relative to the fasteners through the apertures in the bracket 196 and the bracket 185. The upward force of the spring 215 is overcome by the front jack 186 because as the front jack 186 increases in length and the front wheel 198 is lowered, the spring 215 is compressed. When the front wheel 198 is lower than the legs 172 and 174, including the feet 173 and 175, the base 168 may be pivoted about the bolt 142 of the counterweight housing 102. The bushing 145 assists in allowing the extension member 169 to be pivoted about the bolt 142. The front wheel 198 casters inside the base tube 193, and the shaft 191 extends through the bushing 197 connected to the bottom of the mast connector 176. The bushing 197 allows the shaft 191 to move up and down, but the shaft 191 is prevented from rotating by the two brackets 196 also connected to the front jack 186.

The rear wheels 158 and 162 are lowered by rotating the handle of the rear jack 164 to elongate the body of the rear jack 164, which increases the distance between the top 108 of the counterweight housing 102 and the cross bar 152 of the wheel mount assembly 150. Thus, the rear wheels 158 and 162 are lowered by moving the counterweight housing 102 upward and moving the cross bar 152 downward relative to the fasteners through the apertures 111 and 156 and the apertures 115 and 160. When the rear wheels 158 and 162 are lower than the feet 134 and 139, including the rubber footing 135 and 140, then the counterweight assembly 101 may be moved on the rear wheels 158 and 162. Moving the rear wheels 158 and 162 also moves the center of gravity of the counterweight assembly 101 from more proximate the front to proximate the rear wheels 158 and 162. The counterweight assembly 101 is then balanced relative to the rear wheels 158 and 162, which makes it easier to move the counterweight assembly 101. In other words, when the wheels 158 and 162 contact the support surface, the wheels 158 and 162 are proximate the center of gravity of the counterweight assembly 101, which makes the counterweight assembly 101 balanced for transport.

In the anchorage position, the lengths of the bodies of the jacks 164 and 186 are reduced thereby raising the wheels 158, 162, and 198. Thus, when the wheels 158, 162, and 198 are raised, the portable anchorage assembly 100 rests on its feet 134 and 139 and its legs 172 and 174. Moving the wheels 158 and 162 upward and toward the front of the counterweight assembly 101 shifts the center of gravity forward more proximate the front of the counterweight assembly 101 so the weight on the feet 134 and 137 is more toward the front than on the rear of the feet 134 and 137. This offset weight on the feet 134 and 137 of the counterweight assembly 101 is transferred through the extension member 169 to the legs 172 and 174 of the base 168, which increases the downward force on the legs 172 and 174.

Figure 23:
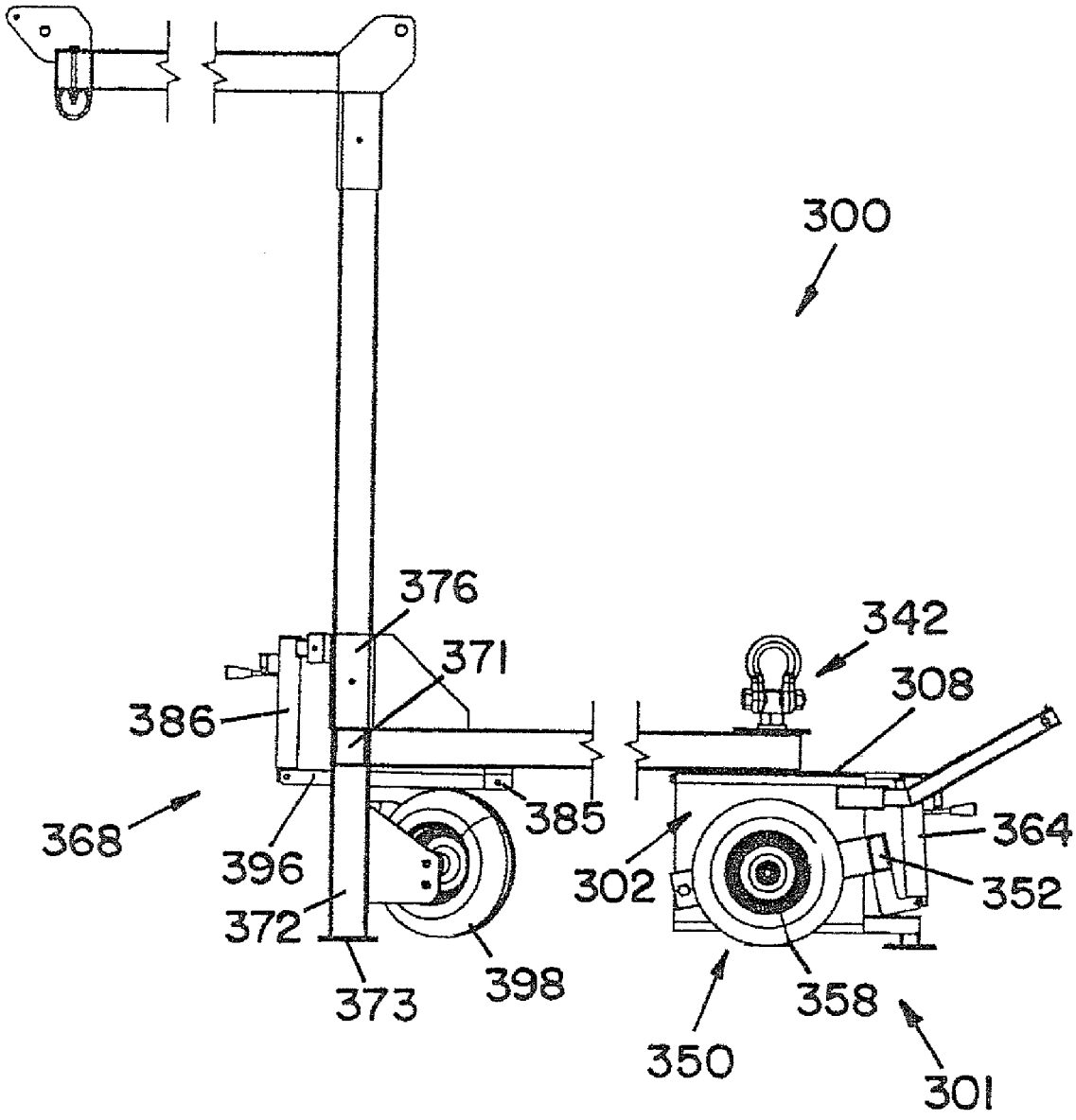
FIG. 23 is a side view of another embodiment portable anchorage assembly constructed according to the principles of the present invention in an anchorage position.
Figure 24:
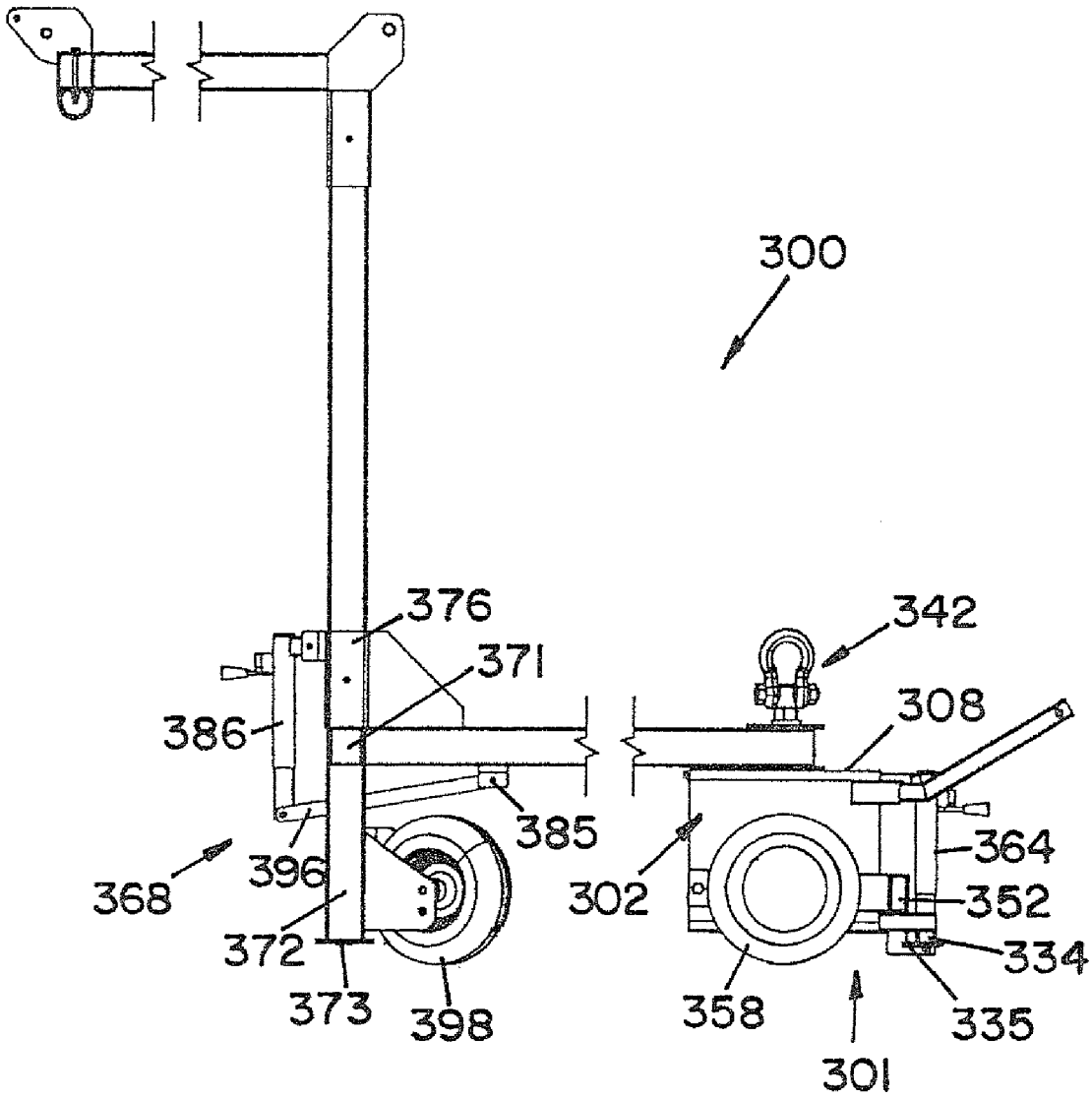
FIG. 24 is a side view of the portable anchorage assembly shown in FIG. 23 in a mobile position.
Figure 28:
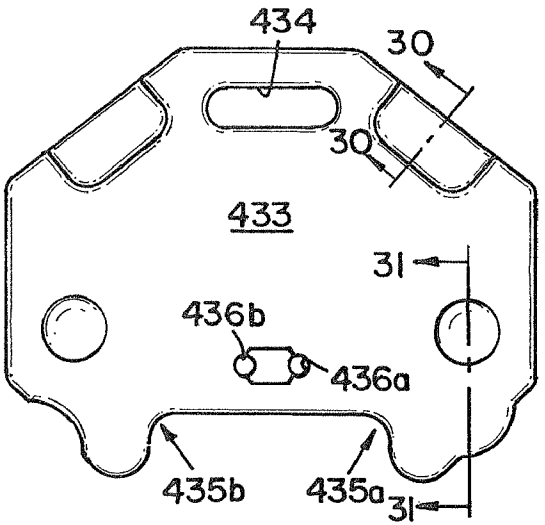
FIG. 28 is a rear view of the weight shown in FIG. 27.
Figure 29:
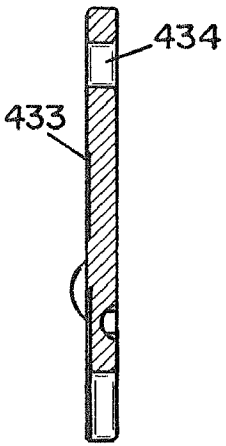
FIG. 29 is a cross section view taken along the lines 29-29 in FIG. 27.
Figure 27:
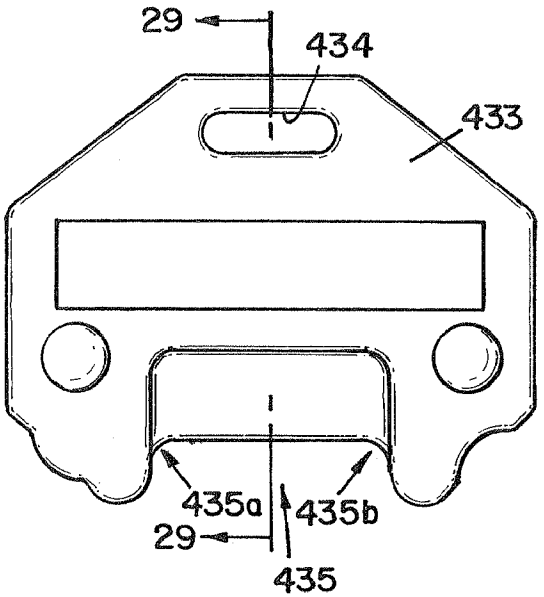
FIG. 27 is a front view of a weight shown in FIG. 26.
Figure 30:
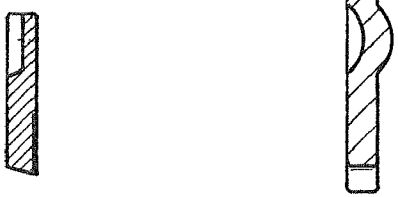
FIG. 30 is a cross section view taken along the lines 30-30 in FIG. 28.
Figure 31:
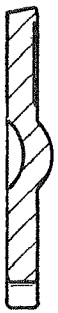
FIG. 31 is a cross section view taken along the lines 31-31 in FIG. 28.

Another embodiment portable anchorage assembly 300 is shown in FIGS. 23 and 24 in an anchorage position and a mobile position, respectively. FIG. 24 shows the portable anchorage assembly 300 in a mobile position with both the front wheel 398 and the rear wheels 358 (only one shown) lowered, but it is recognized that only the front wheel 398 may be lowered. The front wheel 398 is lowered by rotating the handle of the front jack 386 to elongate the body of the front jack 386, which increases the distance between the mast connector 376 and the bracket 396 connected to the front wheel 398. Thus, the front wheel 398 is lowered by moving the cross bar 371 upward and moving the bracket 396 downward relative to the fasteners through the apertures in the bracket 396 and the bracket 385. When the front wheel 398 is lower than the legs 372 (only one shown), including the feet 373 (only one shown), then the base 368 may be pivoted about the bolt 342 of the counterweight housing 302.

The rear wheels 358 (only one shown) are lowered by rotating the handle of the rear jack 364 to elongate the body of the rear jack 364, which increases the distance between the top 308 of the counterweight housing 302 and the cross bar 352 of the wheel mount assembly 350. Thus, the rear wheels 358 (only one shown) are lowered by moving the counterweight housing 302 upward and moving the cross bar 352 downward relative to the fasteners connecting the wheel mount assembly 350 to the counterweight housing 302. When the rear wheels 358 (only one shown) are lower than the feet 334 (only one shown), including the rubber footing 335 (only one shown), then the counterweight assembly 301 may be moved on the rear wheels 358 (only one shown). Moving the rear wheels also moves the center of gravity of the counterweight assembly 301 from more proximate the front to proximate the rear wheels. The counterweight assembly 301 is then balanced relative to the rear wheels, which makes it easier to move the counterweight assembly 301. In other words, when the rear wheels contact the support surface, the rear wheels are proximate the center of gravity of the counterweight assembly 301, which makes the counterweight assembly 301 balanced for transport.

FIG. 23 shows the portable anchorage assembly 300 in the anchorage position. In the anchorage position, the lengths of the bodies of the jacks 364 and 386 are reduced thereby raising the rear wheels 358 (only one shown) and the front wheel 398. For the counterweight housing 302, the center of gravity is moved back to proximate the rear of the counterweight housing 302 making the counterweight assembly 301 more stable proximate the feet 334 (only one shown). When the counterweight housing 302 is resting on its feet 334 (only one shown), the counterweight housing 302 is offset to its rear and transfers load to the front legs 372 (only one shown).

Another embodiment counterweight housing 402 for use with weight plates 433 could be used with the portable anchorage assembly instead of the housings 102 or 302. Because the housing 402 is similar to the housings 102 and 302, only the significant differences will be described. A first elongate member 403*a* and a second elongate member 403*b* are operatively connected, preferably by welding, to the first and second sides 410 and 414 proximate the middle and the bottom side 403. One end of each elongate member 403*a* and 403*b* is connected to the first side 410 and the other end of each elongate member 403*a* and 403*b* is connected to the second side 414. There is preferably a space between the elongate members 403*a* and 403*b*, which extend parallel to one another. The elongate members 403*a* and 403*b* are preferably cylindrical tubes. Preferably centered relative to the space between the elongate members 403*a* and 403*b* and above the elongate members 403*a* and 403*b* are apertures in the sides 410 and 414. First side 410 includes apertures 411*a* and 411*b*, and second side 414 includes apertures 415*a* and 415*b*.

The weight plates 433 include a bottom portion that is preferably wider than a top portion with the tops of the sides tapering inward toward the top. The top portion includes an aperture 434 that provides a handle. The bottom portion includes a notched portion 435 with a first rounded corner 435*a* and a second rounded corner 435*b*. The notched portion 435 is configured and arranged to receive the elongate members 403*a* and 403*b*, and the rounded corners 435*a* and 435*b* correspond with the rounded outer surfaces of the elongate members 403*a* and 403*b*. Above the notched portion 435 are two apertures 436*a* and 436*b*, which correspond with the apertures 411*a* and 411*b* in the first side 410 and the apertures 415*a* and 415*b* in the second side 414. Fasteners 438, which are preferably bolts, extend through the apertures, to secure the weight plates 433 to the respective sides 410 and 414. Washers and lock nuts are used to secure the fasteners 438.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A portable anchorage assembly, comprising:

a counterweight assembly including a housing having a cavity configured and arranged to receive at least one weight, a rear wheel assembly having at least one rear wheel and pivotally connected to the housing, and a rear jack assembly directly interconnecting the housing and the rear wheel assembly;

a base including a cross bar and at least one anchorage point, the cross bar interconnecting a first leg and a second leg;

an extension member having a first end and a second end, the first end being directly pivotally connected to the housing and the second end being directly connected to the cross bar between the first leg and the second leg;

a front wheel assembly having at least one front wheel and pivotally connected to the base, the front wheel assembly configured to allow the base to pivot about the counterweight assembly to position the at least one anchorage point in a desired location;

a front jack assembly interconnecting the front wheel assembly and the base;

wherein the rear jack assembly and the front jack assembly are adjustable in length to raise and lower the respective wheel assemblies, each of the wheel assemblies having an anchorage position and a mobile position;

wherein as the rear jack assembly increases in length, the rear wheel assembly is moved downward and the housing is moved upward thus moving the at least one rear wheel downward to contact a support surface thereby moving the rear wheel assembly from the anchorage position into the mobile position, wherein moving the counterweight assembly from the anchorage position to the mobile position moves a center of gravity of the counterweight assembly from a front end of the counterweight assembly towards a rear end of the counterweight assembly to assist in moving the counterweight assembly more easily;

wherein as the front jack increases in length, the front wheel assembly is moved downward and the base is moved upward thus moving the at least one front wheel downward to contact the support surface thereby moving the front wheel assembly from the anchorage position into the mobile position; and wherein as the rear jack assembly decreases in length, the rear wheel assembly is moved upward and the housing is moved downward thus moving the at least one rear wheel out of contact with the support surface and contacting the support surface with a rear portion of the housing, wherein as the rear wheel assembly is moved from the mobile position to the anchorage position, the center of gravity of the counterweight assembly moves from the rear end of the counterweight assembly toward the front end of the counterweight assembly thereby transferring weight toward the base thereby increasing a downward force on the base and making the portable anchorage assembly more stable as an anchorage structure.

* * * * *